US006879790B2

(12) United States Patent
Phillips et al.

(10) Patent No.: US 6,879,790 B2
(45) Date of Patent: Apr. 12, 2005

(54) CASSETTE LOADING OF PRINTING CONSUMABLES

(75) Inventors: Quintin T. Phillips, Boise, ID (US); Robin P. Yergenson, Eagle, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 09/924,200

(22) Filed: Aug. 7, 2001

(65) Prior Publication Data

US 2003/0031474 A1 Feb. 13, 2003

(51) Int. Cl.[7] ..... G03G 15/00

(52) U.S. Cl. ..... 399/110; 399/12; 399/111; 399/227; 399/262

(58) Field of Search ..... 399/13, 12, 24, 399/25, 27, 31, 111, 258, 262, 110, 119, 226, 227, 393, 228; 222/DIG. 1

(56) References Cited

U.S. PATENT DOCUMENTS

| | | | | |
|---|---|---|---|---|
| 4,611,899 A | * | 9/1986 | Kasamura et al. | 399/12 |
| 4,708,455 A | | 11/1987 | Kubota et al. | |
| 4,937,626 A | * | 6/1990 | Kohtani et al. | 399/12 |
| 4,967,234 A | | 10/1990 | Tani et al. | |
| 4,977,429 A | * | 12/1990 | Tani et al. | 399/13 |
| 5,210,573 A | * | 5/1993 | Fukuchi et al. | 399/111 |
| 5,253,015 A | * | 10/1993 | Morita et al. | 271/127 |
| 5,508,795 A | | 4/1996 | Kikuchi | |
| 5,666,586 A | * | 9/1997 | Nishimura et al. | 222/DIG. 1 |
| 5,757,578 A | * | 5/1998 | Shimoyama et al. | 360/96.5 |
| 5,862,430 A | | 1/1999 | Mitekura et al. | |
| 6,072,967 A | | 6/2000 | Sugihara et al. | |
| 6,091,912 A | * | 7/2000 | Kitajima et al. | 399/119 |
| 6,334,035 B1 | * | 12/2001 | Abe et al. | 399/106 |

FOREIGN PATENT DOCUMENTS

| | | | | |
|---|---|---|---|---|
| JP | 04184464 A | * | 7/1992 | G03G/15/08 |

* cited by examiner

*Primary Examiner*—Robert Beatty

(57) ABSTRACT

A printing consumable loading assembly is provided in an imaging system including a system housing and a printing consumable holding assembly within the system housing. The loading assembly includes at least one consumable-containing cartridge, and at least one opening in the system housing having a size and shape adapted to permit the consumable-containing cartridge to pass therethrough. A guide assembly is connected to the imaging system within the housing. The guide assembly is adapted to receive and grasp a consumable-containing cartridge as it is inserted through the opening in the system housing. The guide assembly guides the consumable-containing cartridge into an in-use position within the printing consumable holding assembly. The loading assembly can accommodate a plurality of consumable-containing cartridges in a variety of ways. In one embodiment, cartridges can be loaded into a plurality of openings in the system housing. In an example, a registration key mechanism is provided on the openings in the system housing and the consumable-containing cartridges, whereby respective consumable-containing cartridges can fit only into corresponding openings in the system housing. The at least one opening in the system housing can be provided as a single opening when there is only one cartridge type to be loaded into the system, e.g., the system is a black-and-white printer. Alternatively, the single-opening loading assembly can be provided in a system where there is a multiple-cartridge loading assembly, such as a carousel mechanism. A method of loading printing consumables in an imaging system is also described.

18 Claims, 2 Drawing Sheets

CASSETTE LOADING OF PRINTING CONSUMABLES

FIELD OF THE INVENTION

The present invention relates generally to printing consumables of imaging systems. Specifically, the present invention relates to an improved loading system for loading printing consumables in imaging systems.

BACKGROUND OF THE INVENTION

Imaging systems such as printers, fax machines, scanners, and copiers are virtually omnipresent, and can be found in homes and offices worldwide. The development of such systems has facilitated improvements in communication that have in turn fostered a profound change in the way people live and work. Telecommuting, "virtual" offices, and intra-office networks represent but a few examples of the advancements that have been made possible by modern imaging systems.

Since these systems have become crucial to everyday existence, their reliability and smooth operation is paramount. It is therefore vitally important to design imaging systems so that downtime and work interruptions are minimized. This can be a daunting challenge, given the relative complexity of systems in which humans are required to perform maintenance tasks, such as monitor and feed paper and printing consumables to the systems, as well as remove paper that is jammed within in the systems.

These tasks can be further complicated by the fact that performing some of these tasks, such as loading consumables, typically require opening an access door that exposes the internal mechanisms of the imaging system. The profusion of rollers, plates, and warning labels can be intimidating to non-technical users, creating the impression that a task as simple as changing a toner cartridge should be attempted only by a trained professional service provider. This frequently results in workflow delays, as the queue of would-be productive workers at the printer grows while awaiting a designated operator to change a toner cartridge To date there is no alternative method to loading printing consumables that would eliminate the need to opening the cover of an imaging system in order to simplify human operations required to maintain these systems. One example of known loading systems is shown in U.S. Pat. No. 5,970,292, directed to a container for storing a supply of particles for use in a developer unit of an electrophotographic printing machine. The container is fittable to an adapter having an adaptor feature therewith. The adaptor is associated with the developer unit. The container includes a body defining a chamber for storing particles therein. The body defines an aperture in the periphery of the body. The container also includes a cover for use in covering the aperture and a securing feature. The securing feature is associated with the cover. The securing feature cooperates with the adapter feature on the adapter to radially secure the cover with respect to the adaptor.

It can thus be seen that the need exists for a more user-friendly loading system for printing consumables.

SUMMARY OF THE INVENTION

An imaging system includes a system housing and a printing consumable holding assembly within the system housing, a printing consumable loading assembly. The loading assembly includes at least one consumable-containing cartridge, and at least one opening in the system housing having a size and shape adapted to permit the consumable-containing cartridge to pass therethrough. A guide assembly is connected to the imaging system within the housing. The guide assembly is adapted to receive a consumable-containing cartridge as it is inserted through the opening in the system housing. The guide assembly guides the consumable-containing cartridge into an in-use position within the printing consumable holding assembly.

The loading assembly can include a control actuator connected to the imaging system and to the guide assembly. In an embodiment, the control actuator has an ejection mechanism connected to the imaging system and to the guide assembly. The ejection mechanism is adapted and constructed to selectively eject a consumable-containing cartridge from the holding assembly.

The loading assembly can further include a sensor adapted and constructed to sense the quantity of consumable within the consumable-containing cartridge. A display connected to display sensor readings can be provided on the system housing.

In another embodiment, an electronic latch can be connected to the sensor and to the ejection mechanism, whereby the electronic latch is capable of automatically actuating the ejection mechanism to eject the consumable-containing cartridge when the sensor indicates that the quantity of consumable within the consumable-containing cartridge is at a predetermined level.

The loading assembly can accommodate a plurality of consumable-containing cartridges in a variety of ways. In one embodiment, cartridges can be loaded into a plurality of openings in the system housing. In an example, a registration key mechanism is provided on the openings in the system housing and the consumable-containing cartridges, whereby respective consumable-containing cartridges can fit only into corresponding openings in the system housing. The registration key mechanism can include a respective fin on each of the consumable-containing cartridges, with the shape and position of the fin indicating a particular aspect of the consumable within the cartridge A respective slot is then provided in each of the openings, with the slots corresponding in shape and position to the fins on the respective consumable-containing cartridges.

The at least one opening in the system housing can be provided as a single opening when there is only one cartridge type to be loaded into the system, e.g., the system is a black-and-white printer. Alternatively, the single-opening loading assembly can be provided in a system where there is a multiple-cartridge loading assembly, such as a carousel mechanism. In this type of system, the guide assembly is mounted within the system housing in a position aligned for loading cartridges into the carousel, whereby the carousel is capable of rotating to a first position to receive cartridges loaded via the opening and the guide assembly, and a second position for image forming.

A method of loading printing consumables in an imaging system is also described.

DESCRIPTION OF THE INVENTION

Figure 1:
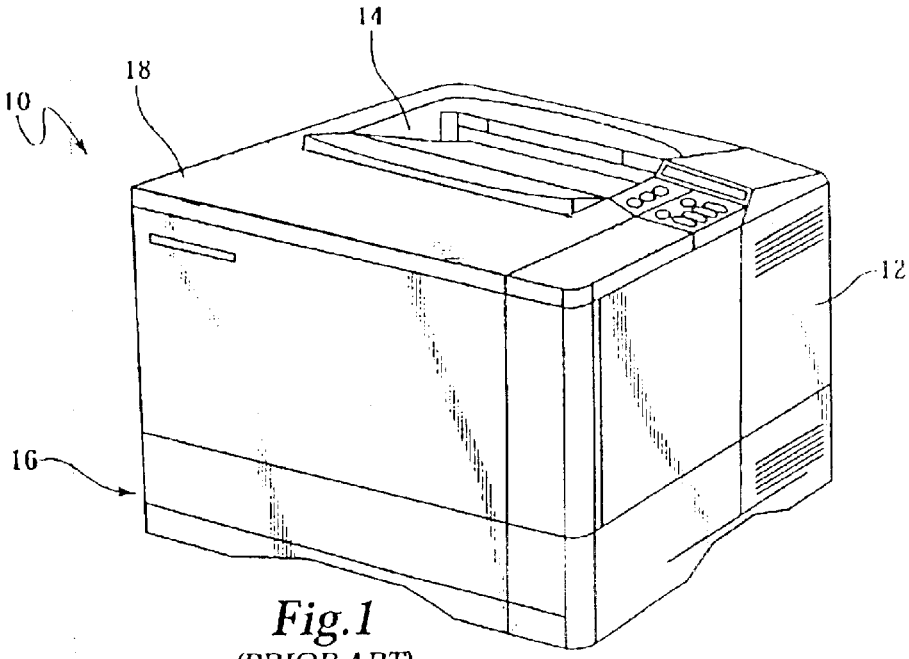
Fig.1 (PRIOR ART)
FIG. 1 is a schematic illustration of an imaging system representing background art.

FIG. 1 illustrates a known imaging system 10. Although the present invention is applicable to any imaging system in which imaging media in the form of sheet material is handled, the imaging system 10 is herein illustrated as a printer 12 including an output tray 14 and an imaging media input section 16. The printer 12 also includes a hinged top functioning as an access door 18. In operation, sheets of imaging media (typically paper, transparencies, and the like) are fed into, and processed by, the printer 12, and fed out of the printer 12 onto the output tray 14. The access door 18 provides access to the interior of the printer 12 for, inter alia, loading and unloading of a printing consumable cartridge.

Figure 2:
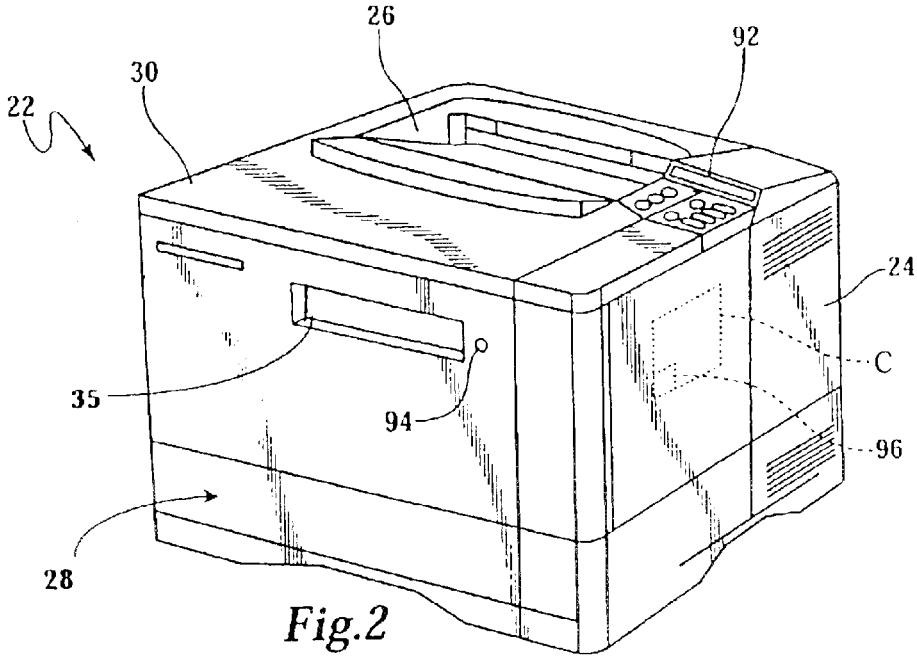
FIG. 2 an imaging system having a loading system in accordance with the principles discussed herein.

An imaging system 22 illustrating the principles of the present invention is shown in FIG. 2. The imaging system 22 is herein illustrated as a printer 24 including an output tray 26 and an imaging media input section 28. The printer 24 also includes a hinged top functioning as an access door 30.

Figure 3:
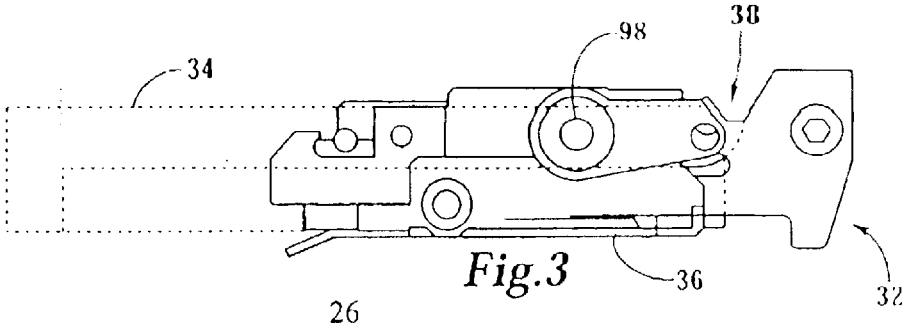
FIG. 3 is a schematic sectional view taken generally along lines III—III of FIG. 2.

Printing consumables loading assembly 32 is shown in detail in FIG. 3. The loading assembly 32 includes a consumables cartridge 34 adapted to contain a consumable printing material, such as toner. An opening 35 is provided in the outer housing of the printer 24, as shown in FIG. 2. The size and shape of the opening 35 is chosen to permit the consumable-containing cartridge 34, seen in FIG. 2, to pass therethrough.

Referring to FIG. 3, the loading assembly 32 also includes a guide assembly 36 adapted to receive and grasp the consumable-containing cartridge 34 as it is inserted through the opening 35 in the printer housing. The guide assembly 36 can be constructed in accordance with known cassette guiding systems, such as that shown in U.S. Pat. No. 5757,578 to Shimoyama et al., the specification and claims of which are incorporated by reference herein. The guide assembly 36 guides the consumable-containing cartridge into an in-use position within a printing consumable holding assembly 38, in the same way that a cassette guide assembly places a tape cassette in a read-write position. As is known in the art, a series of spring-loaded levers and motor-driven cams cooperate to guide the cartridge 34 into its in-use position and to eject the cartridge 34 from the holding assembly 38.

Figure 4:
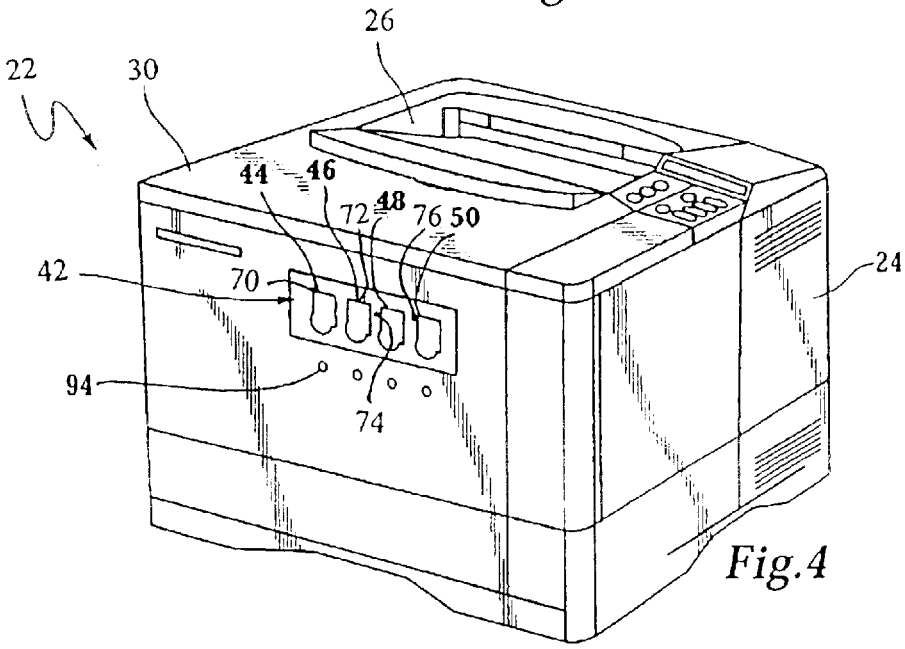
FIG. 4 is a schematic illustration of an imaging system showing another embodiment of a loading system in accordance with the principles discussed herein.
Figure 5:
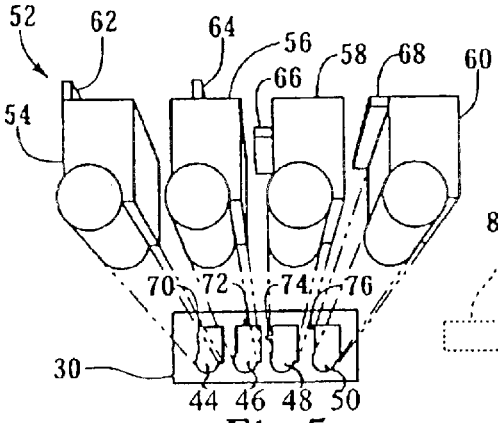
FIG. 5 is a detailed exploded view of the FIG. 4 imaging system with cartridges accordance with the principles discussed herein.

FIG. 4 illustrates imaging system 22 shown as printer 24 including a loading assembly 42 adapted to accommodate a plurality of consumable-containing cartridges. The loading assembly 42 includes a plurality of openings 44, 46, 48, and 50 in the housing of the printer 40. In an example, a registration key mechanism 52 is provided on the openings 44, 46, 48 and 50 in the housing and the consumable-containing cartridges 54, 56, 58, and 60, whereby respective consumable-containing cartridges 54, 56, 58 and 60 can fit only into corresponding openings 44, 46, 48 and 50 in the system housing. The registration key mechanism 52 includes a respective fin 62, 64, 66, and 68 on each of the consumable-containing cartridges 54, 56, 58 and 60, with the shape and position of the fins 62, 64, 66 and 68 indicating a particular aspect of the consumable within the respective cartridges 54, 56, 58 and 60. Respective slots 70, 72, 74, and 76 are then provided contiguous with each of the openings 44, 46, 48 and 50, with the slots 70, 72, 74 and 76 corresponding in shape and position to the fins 62, 64, 66 and 68 on the respective consumable-containing cartridges 54, 56, 58 and 60. Mechanisms for a guide assembly are provided for each of the cartridge types near each of their associated openings, and a holding assembly is provided to maintain the cartridge in an in-use position, as illustrated in the foregoing embodiment.

Figure 6:
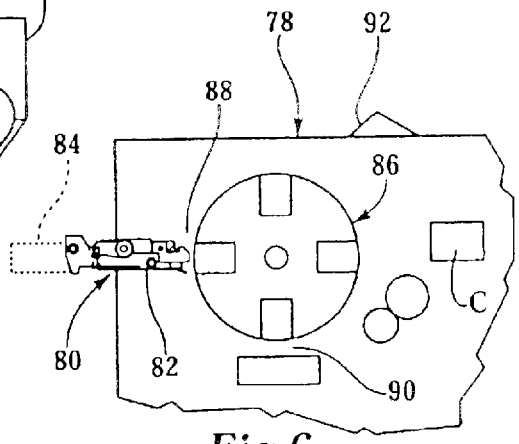
FIG. 6 is a schematic sectional view showing another embodiment of a loading system in accordance with the principles discussed herein in conjunction with a carousel mechanism.

In another embodiment adapted to accommodate a plurality of consumable-containing cartridges, FIG. 6 illustrates a printer 78 having a single-opening loading assembly 80. A guide assembly 82 similar in detail to that shown in FIG. 3 guides a consumable-containing cartridge 84 into an in-use position within a printing consumable holding assembly, here shown as a carousel mechanism 86. Such carousel mechanisms are known in the art, being provided, e.g., in the LaserJet® 4550 printer. In this type of system, the guide assembly 82 is mounted within the printer housing in a position aligned for loading cartridges 84 into the carousel 86. The carousel 86 is capable of rotating to a position at a first station 88 to receive cartridges 84 loaded via the opening and the guide assembly, and a position at a second station 90 for image forming. The carousel mechanism is connected to a central control C of the printer 78, which actuates rotation of the carousel 86 either by a preprogrammed routine or via a series of commands entered via a user interface and display 92.

As illustrated in FIGS. 2 and 4, the loading assembly of the present invention can include a control actuator 94 connected to the imaging system 22 and to the guide assembly 36, as seen in FIG. 3. The control actuator 94 is connected to the ejection mechanism of the guide assembly to selectively eject a consumable-containing cartridge from the holding assembly. The actuator 94 allows a printer operator to selectively eject cartridges for any reason. For example, the loading assembly can include a sensor 96 adapted and constructed to sense the quantity of consumable within the consumable-containing cartridge, with a display 92 connected to the sensor 96 in a known manner. The sensor 96 operates in any suitable, known, manner, such as basing consumable quantity on photoconductor rotations, or on dot counts. The display 92 displays status of the consumable in the cartridge, allowing the user to monitor consumable levels and replace consumable-containing cartridges as necessary.

Cartridge ejection from the loading assembly can also be accomplished automatically. In this example, an electronic latch 98 (FIG. 3) is connected to the sensor 96 and to the ejection mechanism. The electronic latch 98 automatically actuates the ejection mechanism of the guide assembly to eject the consumable-containing cartridge when the sensor indicates that the quantity of consumable within the consumable-containing cartridge is at a predetermined level.

Although the present invention has been described with reference to specific embodiments, those of skill in the art will recognize that changes may be made thereto without departing from the scope and spirit of the invention as defined by the appended claims.

What is claimed is:

1. In an imaging system including a system housing and a cartridge opening formed in the system housing, a printing consumable loading assembly comprising:

a cartridge holding assembly including a guide assembly, the guide assembly including a series of cooperating spring-loaded levers and motor-driven cams for guiding the consumable-containing cartridge to a loaded position when the consumable-containing cartridge is inserted thereby moving the cartridge holding assembly, the cartridge holding assembly connected to the imaging system within the housing;

the consumable-containing cartridge insertable into the guide assembly, the guide assembly adapted to receive the consumable-containing cartridge as it is inserted through the cartridge opening of the imaging system housing, the guide assembly adapted to guide the consumable-containing cartridge to an in-use position within the cartridge holding assembly.

2. A printing consumable loading assembly according to claim 1, further comprising a control actuator connected to the imaging system and to the guide assembly.

3. A printing consumable loading assembly according to claim 2, wherein the control actuator comprises an ejection mechanism connected to the imaging system and to the guide assembly, the ejection mechanism being adapted and constructed to selectively eject a consumable-containing cartridge from the holding assembly.

4. A printing consumable loading assembly according to claim 3, further comprising the following:

a sensor adapted and constructed to sense the quantity of consumable within the consumable-containing cartridge; and a display located on the system housing, the display being connected to the sensor to display sensor readings.

5. A printing consumable loading assembly according to claim 3, wherein the control actuator comprises the following:

a sensor adapted and constructed to sense the quantity of consumable within the consumable-containing cartridge; and an electronic latch connected to the sensor and to the ejection mechanism, the electronic latch being adapted and constructed to automatically actuate the ejection mechanism to eject the consumable-containing cartridge when the sensor indicates that the quantity of consumable within the consumable-containing cartridge is at a predetermined level.

6. A printing consumable loading assembly according to claim 1 further comprising a plurality of consumable-containing cartridges insertable into the cartridge holding assembly of the guide assembly, the guide assembly adapted to receive the plurality of consumable-containing cartridges when inserted through the cartridge opening of the imaging system housing, the guide assembly adapted to guide the plurality of consumable-containing cartridges into an in-use position within the cartridge holding assembly.

7. A printing consumable loading assembly according to claim 1, wherein the cartridge holding assembly further comprises a registration key mechanism on the openings in the system housing and the consumable-containing cartridges, the respective consumable-containing cartridges being configured to fit only into corresponding openings in the system housing.

8. A printing consumable loading assembly according to claim 7, wherein the registration key mechanism comprises the following:

a respective fin on each of the consumable-containing cartridges, the shape and position of the fin indicating a particular aspect of the consumable within the cartridge; and a respective slot in each of the openings, the slots corresponding in shape and position to the fins on the respective consumable-containing cartridges.

9. A printing consumable loading assembly according to claim 1, wherein the cartridge holding assembly includes a carousel adapted and constructed to hold a plurality of consumable-containing cartridges, and the guide assembly is mounted within the system housing in a position aligned for loading cartridges into the carousel, the carousel being configured to rotate to a first position to receive cartridges loaded via the opening and the guide assembly, and a second position for image forming.

10. A printing consumable loading assembly according to claim 1, further comprising a hinged door over the cartridge opening in the system housing.

11. An imaging system comprising:

an imaging system housing;

the imaging system housing including at least one cartridge opening;

a printing consumable loading assembly including, a cartridge holding assembly, the cartridge holding assembly including a guide assembly, the guide assembly including a series of spring-loaded levers and cooperating motor-driven cams to guide at least one consumable-containing cartridge into an in-use position, the cartridge holding assembly connected to the imaging system within the housing; and the at least one consumable-containing cartridge insertable into the cartridge holding assembly of the guide assembly, the guide assembly adapted to receive the at least one consumable-containing cartridge as it is inserted through the at least one cartridge opening of the imaging system housing, the guide assembly adapted to transport the consumables cartridge into an in-use position within the cartridge holding assembly.

12. An imaging system according to claim 11, further comprising a control actuator connected to the imaging system and to the guide assembly, the control actuator including an ejection mechanism connected to the imaging system and to the guide assembly, the ejection mechanism being adapted and constructed to selectively eject a consumable-containing cartridge from the holding assembly.

13. An imaging system according to claim 12, further comprising the following:

a sensor adapted and constructed to sense the quantity of consumable within the consumable-containing cartridge; and a display located on the system housing, the display being connected to the sensor to display sensor readings.

14. An imaging system according to claim 11, wherein the at least one consumable-containing cartridge comprises a plurality of consumable-containing cartridges.

15. An imaging system according to claim 14, wherein the at least one opening in the system housing comprises a plurality of openings in the system housing.

16. An imaging system according to claim 15, further comprising a registration key mechanism on the openings in the system housing and the consumable-containing cartridges, the respective consumable-containing cartridges being configured to fit only into corresponding openings in the system housing.

17. An imaging system according to claim 11, wherein the holding assembly includes a carousel adapted and constructed to hold a plurality of consumable-containing cartridges, and the guide assembly is mounted within the system housing in a position aligned for loading cartridges into the carousel, the carousel being adapted and constructed to rotate to a first position to receive cartridges loaded via the opening and the guide assembly, and a second position for image forming.

18. A method of loading a consumable-containing cartridge in an imaging system including an imaging system housing including a cartridge opening formed in the system housing and cartridge holding assembly including a guide assembly, the guide assembly including a series of cooperating spring-loaded levers and motor-driven cams for guiding the consumable-containing cartridge to a loaded position when the consumable-containing cartridge is inserted thereby moving the cartridge holding assembly, the guide assembly aligned with the cartridge opening of the imaging system housing, the method comprising the following steps:

inserting the consumable-containing cartridge into the cartridge holding assembly through the cartridge opening formed in the system housing; and receiving the consumable-containing cartridge in the cartridge holding assembly as it is inserted through the cartridge opening of the imaging system housing; and guiding the consumable-containing cartridge into an in-use position with the cartridge holding assembly.

* * * * *